United States Patent [19]

Strout et al.

[11] Patent Number: 4,522,348

[45] Date of Patent: Jun. 11, 1985

[54] PORTABLE, MANUALLY OPERABLE DISPENSER FOR STRETCH FILM AND THE LIKE, AND PROCESS OF APPLYING

[75] Inventors: Russell B. Strout, Winchester; Jerold J. Golner, Lowell, both of Mass.

[73] Assignee: Borden, Inc., Columbus, Ohio

[21] Appl. No.: 397,939

[22] Filed: Jul. 13, 1982

[51] Int. Cl.[3] ..... B65H 23/06

[52] U.S. Cl. ..... 242/96; 53/399; 53/441; 53/587; 53/390; 242/99; 242/75.4

[58] Field of Search ..... 53/556, 587, 390, 441, 53/399; 242/75.4, 96, 99, 156; 188/336, 337

[56] References Cited

U.S. PATENT DOCUMENTS

| | | | |
|---|---|---|---|
| 836,084 | 11/1906 | Bradley | 188/336 |
| 1,110,136 | 9/1914 | Hundhausen | 242/72 |
| 2,655,776 | 10/1953 | Bennett . | |
| 2,914,893 | 12/1959 | Berst . | |
| 3,093,943 | 6/1963 | Kazimir . | |
| 3,476,332 | 11/1969 | Sutz | 242/99 |
| 3,532,289 | 10/1970 | Sutz | 242/99 |
| 4,050,221 | 9/1977 | Lancaster | 53/556 |
| 4,102,513 | 7/1978 | Guard . | |
| 4,166,589 | 9/1979 | Hoover et al. . | |
| 4,248,392 | 2/1981 | Parry | 242/96 |

*Primary Examiner*—John Sipos

*Attorney, Agent, or Firm*—Robbins & Laramie

[57] ABSTRACT

The invention relates to a dispenser for a web of wrapping material having a conveniently operable manual braking mechanism. The invention generally comprises first and second side members adjacent to each side of a roll of wrapping material, respectively. Each of these side members has a bearing member disposed thereon for supporting the core of said roll and for permitting the core and roll to rotate incident to a dispensing operation. At least one of the bearing members is insertable into the core and has an expandible bearing surface on which the core end can rotate when the surface is in its unexpanded state. A manually operated means associated with one or both of the side plates operates to expand the bearing surface at the film is paid out, thereby acting as a braking means to apply tension to the film as it is applied.

7 Claims, 3 Drawing Figures

PORTABLE, MANUALLY OPERABLE DISPENSER FOR STRETCH FILM AND THE LIKE, AND PROCESS OF APPLYING

BACKGROUND OF THE INVENTION

1. Field of the Invention

This invention relates to a portable, manually operable dispenser for use with stretch wrap film that is particularly useful for wrapping roll goods.

2. Description of the Prior Art

Stretch wrap film has enjoyed increasing use in all forms of packaging. Stretch wrappers are now applied to unify or contain boxes, bales, sacks, mixed loads, or even a plurality of items of non-uniform shape, such as axe handles. Stretch wrap film is also commonly used to secure a plurality of containers on a pallet. Examples of such uses for stretch film appear in U.S. Pat. Nos. 3,495,375 and 3,867,806. The advantages of using stretch wrap film include its stength despite its lightness, good holding ability, relatively low cost, freedom from the need to use tape or adhesive, and toughness.

Stretch wrap machinery for applying the film ranges from small hand-held devices to very expensive, fully automatic turntable units. Each of these devices is intended for use in applying one or more layers of a thin stretchable film about a load in order to unite it or, to use the industry term, "unitize" it.

For efficient film usage, any device used for film application must include some means for controlling the tension on the film as it is applied. Some large automatic pallet wrapping machines include a core type brake system consisting of a friction element inserted in the hollow core of a film roll. Such a mechanism controls the amount of tension or pull that is applied to the film as the pallet load is unitized. There is also available a surface controlled tension device that features a reduced level of tension initially. For best results, the tensioning mechanism should assure consistent film application so that there is efficient film usage plus flexibility in unitizing loads of different shapes, sizes and weights.

Generally, stretch film machinery that does not offer some form of tension control requires manual adjustment of the tension on the film roll as the film roll decreases in size or as load requirements demand.

Past developments in braking mechanisms for stretch film machinery are represented by U.S. Pat. Nos. 2,655,776; 2,914,893; 4,102,513 and 4,166,589. The latter two of these patents disclose hand-held plastic film wrapping dispensers with friction brake means for controlling the tension on the film during the wrapping operation. In U.S. Pat. No. 4,102,513, adjustment of a threaded member applies or releases braking action. In U.S. Pat. No. 4,166,589, the brake is operated by a cam action. In these hand-held devices, the braking action requires a manual rotary movement by the operator, who is simultaneously holding the device and the film roll, guiding the film so that it is applied over the desired path, and orienting the device as necessary for the job. Considerable dexterity and strength are required.

SUMMARY OF THE INVENTION

The wrapper or dispenser unit of the present invention is designed to allow a manufacturer of roll goods to wind a spiral of stretch film or other wrapping material about the roll of product and around the ends of the goods. In many cases the same winder on which the goods are rolled during their manufacture can be used for the wrapping process. The dispenser has a manually operable braking system that is essentially infinitely adjustable to permit the application of braking tension over a wide range, so that the tension in the film is readily controllable during the spiral wrapping process. While particularly intended for use with roll goods, it can be used for pallet wrapping and other purposes.

A particularly advantageous feature of the invention is that a braking action is applied onto the film during a wrapping operation by a squeezing action that is simple to control and that does not interfere with or complicate the other tasks being simultaneously performed by the operator. This simple squeezing action provides infinite adjustment of the braking force and film tension in a way that permits the operator to have total control over the wrapping operation. At the same time, there is minimal exertion by the operator since the braking force is generated in a way that makes favorable use of mechanical advantage.

While the wrapper is particularly intended for use with roll goods and generally for horizontal wrapping of textile materials, it is also useful in other applications, such as for unitizing pallet loads. It is especially advantageous for pallet jobs where the use of automatic machinery is not justified.

DETAILED DESCRIPTION OF THE INVENTION

The dispenser of the present invention is especially adapted for use with high performance stretch wrap film. While the preferred stretch film is plasticized polyvinyl chloride, other suitable wrapping materials include low density polyethylene, ethylene vinyl acetate, and in addition, plastic netting. However, the dispenser can be used with any web, such as brown wrapping paper.

These wrapping materials are commercially available in rolls in which the film or netting is wound on a tubular core. Usually the core is in the form of a hollow cylinder of cardboard but other core materials are also in use.

Referring specifically to the drawings, according to one preferred embodiment of the invention, the film dispenser comprises a pair of side plates 10 and 12 respectively. Generally these side plates are identical in construction except that one is left-handed and the other right-handed. Accordingly, the construction of one side plate will be described in detail, it being understood that the other side plate is similar in construction but designed for use on the opposite side of the dispenser.

Figure 1:
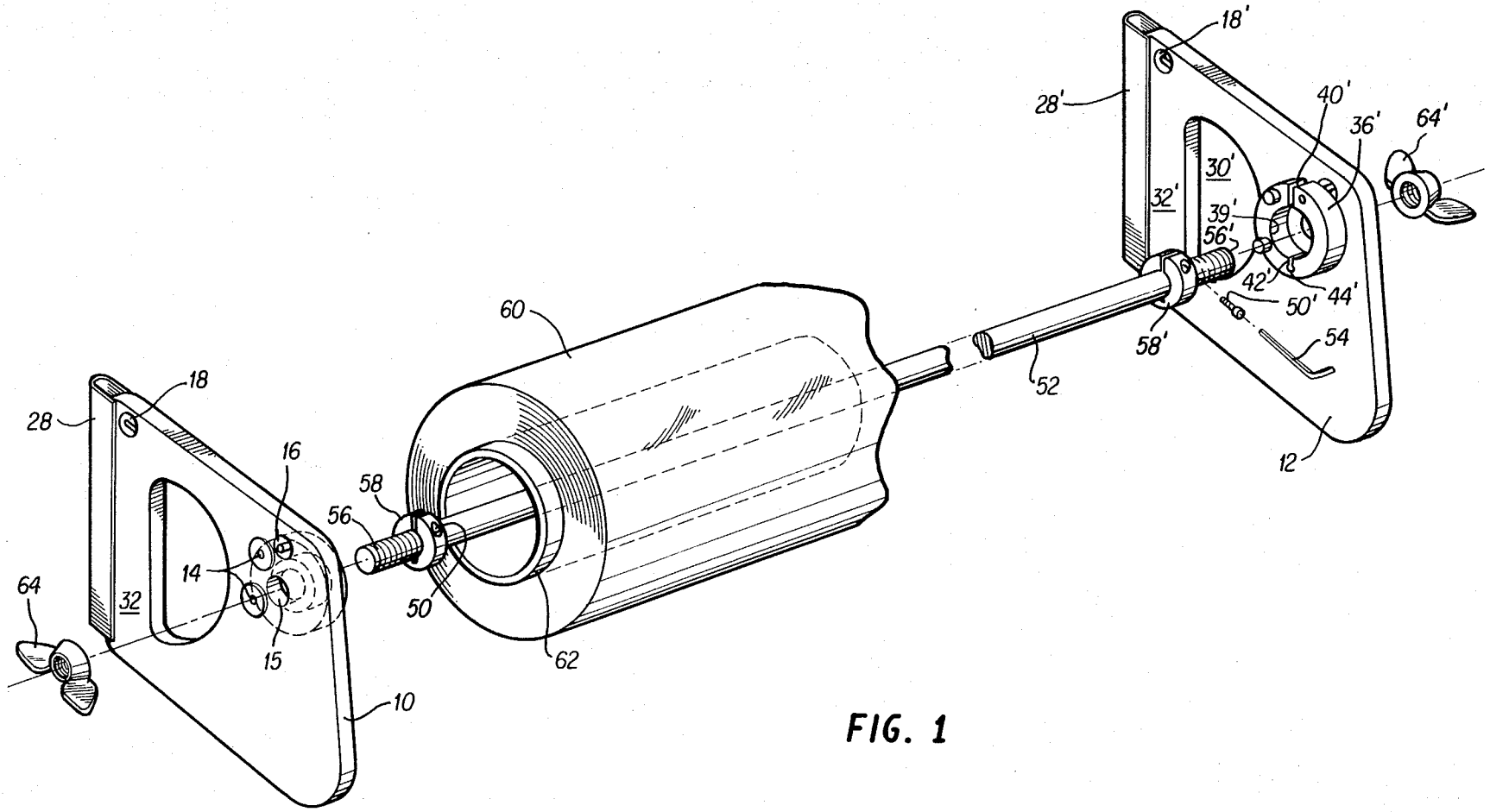
FIG. 1 is a fragmentary, exploded, perspective view of a portable dispenser for a film roll constructed in accordance with one preferred embodiment of the invention and showing a film roll, partly broken away, mounted on a tubular core and positioned as it would be in the assembled form of the device relative to the tie rod that holds the device together.
Figure 2:
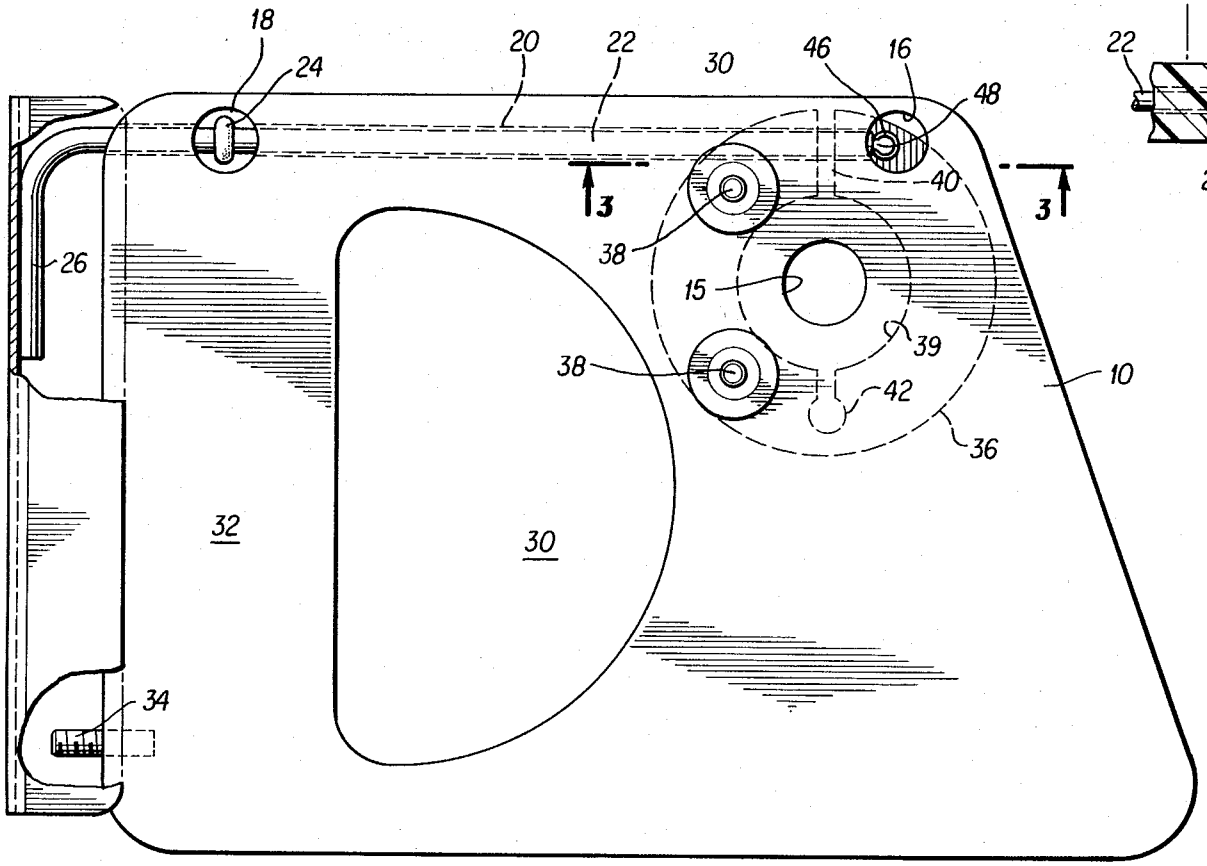
FIG. 2 is a side elevation partly broken away on an enlarged scale, showing the side plate that is nearest to the observer in FIG. 1 hereof.

Referring now in detail to FIGS. 1 and 2, the side plate 10 may be molded in a single piece from a machineable plastic that is light in weight yet strong. It is formed with a plurality of transverse bores, including countersunk bores 14 and a nearby larger bore 15, for a purpose to be described presently, and a pair of see-through bores 16 and 18 that are generally of the same size as each other and that are cylindrical. Bores 16 and 18 are located in the upper part of the side plate 10 with their axes being in horizontal registry with each other when the side plate 10 is in the at rest position shown in FIG. 2. All of these bores extend completely transversely through the side plate 10.

The side plate 10 is also formed with a cylindrical channel 20 horizontally extending partly therethrough which communicates with the transverse bores 16 and 18. A rod 22 is disposed in the channel 20 for sliding movement therein. The rod 22 has a generally cylindrical retainer ring 24 secured thereto which is disposed within the bore 18 in the side plate 20. The sides of the bore 18 limit movement of the retainer ring 24 upon reciprocatory movement of the rod and thus limit the distance that the rod 22 can travel in its channel 20. The rod 22 is formed with a downwardly depending extension 26 at a right angle to the main portion of the rod. This extension 26 is secured to the inside face of a cover plate 28 that is generally U-shaped in cross section in a horizontal plane.

The side plate 10 is also formed with a large opening 30 that is bounded in part by an upright post part 32 of the side plate. A pin 34 is disposed to extend from the post part 32 into the channel between the arms of the U-shaped cover plate 28 to limit movement of the cover plate. The cover plate 28 is disposed for reciprocating sliding movement relative to the side plate 10.

Figure 3:
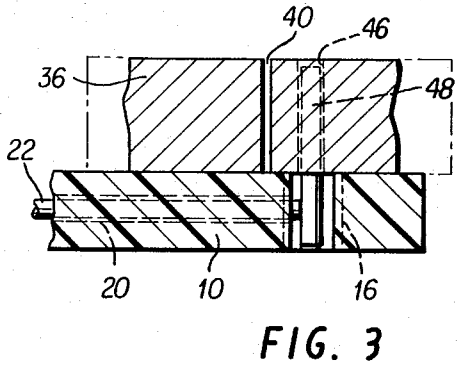
FIG. 3 is a fragmentary section taken on the line 3—3 of FIG. 2 looking in the direction of the arrows.

As best shown in FIG. 3, a generally cylindrical ring 36 is disposed on one face of the side plate 10 which is secured in place by a pair of fasteners 38 that extend through the bores 14 in the side plate 10 and into openings (not shown) in the ring 36. This generally cylindrical ring 36 is formed with a large center bore 39 that is generally coaxial with both the bore 15 in the side plate 10, and with a radially and axially extending slot 40. Diametrically opposite the slot 40, the ring 36 is formed with another radially and axially extending slot 42 that, unlike the slot 40, does not extend completely through the thickness of the ring but only partly through the thickness of the ring, communicating with and terminating in an axially-extending bore 44 that extends lengthwise (axially) of the ring through the entire length of the ring.

The ring 36 is also formed with an axially-extending bore 46 that communicates with the larger bore 16 in the side plate 10, as best shown in FIG. 3. A split pin 48 is engaged in the bore 46. The pin 48 is split lengthwise (not shown) to permit it to be compressed slightly to facilitate insertion in the bore 46, and to permit it to expand within the bore 46 once inserted, to be retained in place by frictional engagement. The length of the split pin 48 is such that it projects into the bore 16 in the side plate 10. The outer end of split pin 48 is almost flush with the surface of the side plate. The free end of the rod 22 normally rests against one side of the end of the split pin 48 that projects into the bore 16 in the side plate 10, as shown in FIGS. 2 and 3.

Corresponding parts of the other-handed side plate 12 are indicated, as appropriate, by primed numerals.

A tie rod 52 is provided to extend between and unite the two side plates 10 and 12 respectively. The distal end of the rod 52, in FIG. 1 is disposed so that it can be passed through the center bore 39' of the ring 36', to engage snugly within the bore 15' (not shown) in the side plate 12. To permit the rod 52 to be assembled to the side plates, the rod 52 has threaded ends 56. Adjacent the ends of each of these threaded segments, split rings 58 and 58' are mounted, respectively. Each split ring 58, 58' has a threaded bore that extends from one half of the split ring into the other, and in which a set screw 50, 50' is engaged. To clamp each split ring in place at its respective end of the rod 52, an Allen wrench 54 is employed to tighten the set screw until it draws the two halves of the split ring together to clamp the split ring on the rod 52 and hold it against axial and rotary movement. Wing nuts 64, 64' are provided for a purpose to be described presently.

For assembly of the dispenser, a roll of film 60 that is wound on a tubular core 62 is placed on the rod 52. The threaded end section 56 of the rod is then inserted through the bore 15 in the side plate 10, and the wing nut 64 is threaded onto the projecting threaded end 56 of the rod.

The external diameters of the rings 36 and 36' are such as to receive the ends of the core 62 thereover so that the core is supported on a broad bearing surface but is free to rotate. In addition, the length of the rod 52 is such that the core 62 is easily received between the two side plates 10 and 12. To complete the assembly, the other threaded end 56' of the rod 62 is inserted through the corresponding bore in the side plate 12, and the wing nut 64' is threaded onto that end of the rod. The wing nuts 64, 64' are then tightened to eliminate play and complete the assembly.

In a preferred embodiment, the invention is used with a tough, abrasion-resistant polyvinyl chloride stretch film. While other films may be used, it should be one that, like polyvinyl chloride, will not lose strength under tension and will not puncture easily under pressure. Polyvinyl chloride film is unique in that it clings to itself so that after the wrapping operation is completed, the free end of the film may simply be placed over an underlying film layer where it will cling to it without the need for tape or other sealing means, although tape of other fastening means may be used if desired.

To use the dispenser embodiment described, a roll of polyvinyl chloride stretch wrap film is assembled on the dispenser. The operator then grasps the free end of the film on the roll and places it on the material to be wrapped. When the material being wrapped is a rolled product, such as a roll of a textile, paper, carpet or foam, the roll goods may be wrapped with film directly on the winder. In this case the winder is started and the first wrapping of film is applied without tension. A small piece of tape may be applied at the free end of the film before the winder is started to insure that there is no slippage. After the first wrapping of film has been applied, any overlapping between subsequently applied windings tends to hold the film in place because it clings to itself. In addition, the cling characteristic gives a laminating effect to multiple layers which compounds the strength of the wrapping.

Once the initial layer of film has been applied to the roll goods, the winder is actuated. The operator then operates the dispenser, holding one side plate in each hand. Manual squeezing action on either side plate will cause the cover plate 28, which functions as the brake handle, to slide on its respective side plate and move the rod 22 forward. Consequently, the end of the rod 22 engages against the end of the split pin 48 and exerts pressure on the side of the split ring 36 which is not secured to the side plate. The slots 40 and 42, together with the bore 40, permit the ring to be expanded by the pressure transmitted through the split pin 48 by the push rod 22. The expanded split ring 36 engages against the overlying internal surface of the core 62 of the film roll and exerts a braking action. This produces a resistance to unwinding and creates tension in the film. By applying a squeezing force on one or both cover plates or brake handles 28, 28' the tension across the width of the film is created.

Whether the tension is generated by one-handed or two-handed braking, only a shallow squeezing movement is needed to produce an infinite number of different braking forces over a wide range. A skilled operator can sense the tension that is manually generated by sensing the applied braking pressure as it is applied. It should be noted that the hand hold need not be released to adjust the tension in the film, and that the braking mechanism does not carry the weight of the film roll.

The operator can pick up the dispenser by the hand holes in the two side plates, and walk along the length of the roll goods products as they are rotated on the winder, and continuously apply tension to the film while simultaneously turning or inclining the dispenser slightly so that the film winds in a spiral. To secure the film over an end of the roll goods, the dispenser is turned at an angle to the axis of the roll goods to achieve the desired coverage. After the film has been completely applied to the extent desired, it is cut. Plasticized polyvinyl chloride film will cling to itself and form a sturdy bond. If the film being used is not self-clinging, tape may be applied to hold the loose end in place.

The hand-held dispenser of the invention is especially useful for all kinds of rolled products and is especially advantageous for fiberglass insulation since the film forms a tight envelope that limits the escape of small glass fibers into the atmosphere.

In addition, a single size of film roll can be used to wrap roll goods of any axial length through use of the spiraling technique. The dispenser requires only minimal investment and is readily portable. No electric power connections are needed. Application of the film is easy and convenient.

While the invention has been described in connection with a specific embodiment thereof, it should be understood that mechanically equivalent devices are contemplated and are within the scope of the invention. For example, instead of a push rod operating against a split ring through a mechanical interconnection, the push rod could operate against a cam.

While the dispenser of the invention is particularly intended for wrapping roll goods on a winder, with the dispenser being held in a generally horizontal position, the dispenser can be used in other positions and for many other applications. For example, the dispenser can be held in a vertical position where the goods to be wrapped are mounted on a turntable for example, or where the goods to be wrapped are mounted on a stationary table and the operator must walk around the goods. The dispenser is very useful for uniting bundles of materials of unusual configuration; metal extrusions; bulk loads of bagged goods; sheeted materials; flat, unassembled cartons, and the like.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A dispenser for a web of wrapping material in the form of a roll of the material that is wound on a tubular core, comprising at least one side member having a side plate with a hand hold opening and a bearing member disposed thereon for supporting the core of said roll and permitting the core and roll to rotate for dispensing the web of wrapping material from the roll, wherein said bearing member is in the form of a means insertable in the core, and includes a bearing surface on which the core end can rotate, said bearing surface further having at least one part that is expandable for engagement against the inside surface of the core to function as a braking means to permit tensioning of the film as the film is paid out, and a brake controller including a pushable member mounted within said hand hold opening, a push rod mounted for reciprocating movement on said side plate and oriented substantially perpendicularly to the axis of rotation of the roll, said push rod being operatively connected to said pushable member and to said bearing member, said controller being operable through a squeezing force applied by a hand inserted within said hand hold opening and squeezing said pushable member to cause engagement of said expandable part to a desired degree to adjust the braking force on the core while said core is rotating on said bearing member and thereby control the tension in the wrapping material as it is applied, wherein said brake controller and said bearing member coact to provide a mechanical advantage between the squeezing force and the resulting braking force.

2. A dispenser according to claim 1 wherein the wrapping material is a roll of stretch film.

3. A dispenser according to claim 1 wherein said bearing member includes a split ring which serves to bias the push rod to urge it to a position in which there is no braking force applied to the core by the braking mechanism.

4. A dispenser according to claim 1, 2 or 3, comprising two side members which are identically constructed and wherein each has said recited means for applying braking to the core at each of its ends, each said braking means being operable independently of the other.

5. A portable dispenser for a web of wrapping material in the form of a roll of the material that is wound on a tubular core, comprising a pair of side members, one for each side of the roll, wherein each of the side members has a hand hold opening with a pushable member mounted within said opening, and a bearing member disposed therein for supporting the core of the roll and permitting the core and roll to rotate for dispensing the web of wrapping material from the roll, both of said bearing members being in the form of a means insertable into said core, wherein each bearing member has a bearing surface on which the core end can rotate, and said surface having at least one part that is expandable for engagement against the inside surface of its respective core end to function as a braking means to permit tensioning of the film as the film is played out, and a pair of push rod members, each mounted for sliding reciprocation on one of said side members and oriented transversally to the axis of rotation of the roll, each push rod is connected to the pushable member and the bearing member, said braking means being operable through a manually-generated squeezing force applied by hands inserted within said hand hold openings and squeezing said pushable members to cause engagement of the expandable parts of the bearing members to a desired degree in order to adjust the braking force on the core while said core is rotating on said bearing members, wherein the push rod members and the bearing members coact to provide a mechanical advantage between the squeezing force manually applied and the resulting braking force.

6. The dispenser of claim 5, additionally comprising tie rod means insertable in the bore of a tubular core of wrapping material, and means securing the opposite ends of said tie rod means to said side members to permit said dispenser to be handled as a unit.

7. The dispenser of claim 1, additionally comprising tie rod means insertable in the bore of a tubular core of wrapping material, and means securing the opposite ends of said tie rod means to said side members to permit said dispenser to be handled as a unit.

* * * * *